United States Patent [19]

Terrien et al.

[11] 4,393,533

[45] Jul. 19, 1983

[54] DEVICE FOR LAP-JOINT ENGAGEMENT OF TWO BRIDGE ELEMENTS ON INTRADOS OR EXTRADOS AND BRIDGE ELEMENT COMPRISING IT

[75] Inventors: Michel E. Terrien; Claude Bouvet, both of Angers, France

[73] Assignee: Etat Francais, Paris, France

[21] Appl. No.: 289,782

[22] Filed: Aug. 3, 1981

[30] Foreign Application Priority Data

Aug. 21, 1980 [FR] France ..... 80 18257

[51] Int. Cl.[3] ..... E01D 15/14

[52] U.S. Cl. ..... 14/2.6; 14/14; 14/27

[58] Field of Search ..... 14/14, 27, 2.4, 2.6; 404/41; 52/127.12, 127.7, 543, 584

[56] References Cited

U.S. PATENT DOCUMENTS

| | | | |
|---|---|---|---|
| 1,157,469 | 10/1915 | von Philp | 52/584 |
| 1,439,650 | 12/1922 | Thomas | 52/584 X |
| 2,017,185 | 10/1935 | Rockwell | 52/127.7 X |
| 2,887,740 | 5/1959 | Potchen | 52/584 X |
| 3,060,641 | 10/1962 | Lockwood | 52/584 X |
| 3,066,332 | 12/1962 | Sedlacek | 14/14 |
| 3,634,989 | 1/1972 | Rogers | 52/584 |

*Primary Examiner*—Nile C. Byers, Jr.

*Attorney, Agent, or Firm*—Parkhurst & Oliff

[57] ABSTRACT

The present invention relates to means for connecting two fixed or floating bridge elements together. A first bridge element comprises at least two retractable studs (1, 2) oriented obliquely with respect to the surface of the element, one on the intrados and the other on the extrados, so as to cooperate with a recess (3', 4') either of the extrados or of the intrados of a second bridge element. This invention may be used to assemble all types of bridges.

12 Claims, 4 Drawing Figures

DEVICE FOR LAP-JOINT ENGAGEMENT OF TWO BRIDGE ELEMENTS ON INTRADOS OR EXTRADOS AND BRIDGE ELEMENT COMPRISING IT

The present invention lies within the technical field of fixed or floating bridges, and more precisely, of means for connecting two bridge elements to each other.

Numerous devices have already been proposed in this field. French Pat. No. 2 158 618 discloses a device for the lap assembling of two bridge elements, that is to say, an assembly in which the two elements to be assembled are superimposed at their ends. This device comprises a ball suspended from a tackle chain in order to assemble the two elements and fixed protruding spherical centering pins engaged in funnels. The locking is effected by an annexed assembly of hooks actuated by jacks.

The primary function of this device is to pick up and deposit a bridge element, and it requires manual labor to put the grasping balls in place. In certain useages, the non-effacing centering pins may be subjected to damage.

German Pat. No. 1 124 383 describes a device for assembling two bridge elements end to end which requires manual operation in order to put the locking hooks in place.

Other devices used on bridging equipment are also known.

However, all of these devices, depending on their type, comprise strap bolts, yokes, and hooks or mechanical or hydraulic spindles serving both as assembler and interlocker. These arrangements are not always protected from dirt and are at times subject to extensive damage due to vehicular traffic. These problems make the unlocking and disassembling operations of the bridge elements difficult. Furthermore, most of these devices are put in place manually, although some of them are semi-automatic.

One of the objects of the present invention is to provide an engagement device which makes it possible to maintain bridge elements assembled and locked to each other (so-called lap assembly). Bridge elements such as walkways, beams, joists, and ramps are extended from fixed or floating supports so as to construct a structure in which it is possible for vehicles to pass over any type of gap, while avoiding the drawbacks inherent in the previous arrangements.

Another object of the invention is to reduce the time required in order to place a bridge in use. This is accomplished by installing an automatic interlock after assembly.

Another object of the invention is to assure continuity of the roadway formed by the different assembled elements as well as to permit the assembly of completely identical elements without particularization.

Another object of the invention is to permit lap assembling, that is to say, assemblying by superimposing the ends of the elements either on the extrados of one element or on the intrados of one element, depending on the circumstances, without having to modify or adapt each element in accordance with the position selected.

The object of the invention is therefore an automatic device for the lap engagement of two bridge elements either on extrados or on intrados, the lower bridge element being capable of becoming the upper element and vice versa, comprising in combination a centering means and means for connecting the two elements, the connecting means being formed of at least two rectractable studs belonging to one bridge element, which are located on axes oblique with respect to the surface of the element, the two studs being adapted to cooperate with two recesses in the second bridge element having the same inclination as the studs with respect to the surface of the second element.

In accordance with a first embodiment of the invention, the two connecting studs of the first element debouch on the same face as the latter (extrados or intrados) while, in accordance with a second embodiment, the first element has a first connecting stud debouching on its intrados and a second stud on its extrados while the second element has a first recess on the extrados and a second on the intrados in order to cooperate with the two studs of the first element.

In accordance with one feature of the invention, a first bridge element has at least one row of two retractable studs, each row of studs being disposed along an axis perpendicular to the longitudinal axis of the bridge element, the second element having at least one row of recesses adapted to cooperate with the studs of the first element.

In accordance with another feature of the invention, the means for the centering of the two bridge elements consist of a retractable centering finger on the first element, located along an axis perpendicular to the surface of the first element in the highest part of the structure of said element and adapted to cooperate with a corresponding recess provided in the end of the second element.

The centering finger may be locked, for instance, by means of a removable key belonging to the second bridge element and cooperating with a borehole in the centering finger of the first element.

Another object of the invention is a bridge element which comprises one of the said engagement devices and which is then characterized by the fact that it comprises, in combination

- in the highest part of its structure at least one retracted centering finger the axis of which is perpendicular to the surface of the element;
- at its end at least one hollow recess adapted to receive a centering finger and to lock it by means of a key so as to prevent the bridge element from pivoting, whereupon the locking of the bridge elements to each other can be effected.

The bridge element may also comprise at least one row of retractable studs located on axes which are oblique with respect to the surfaces of the element, each row comprising at least one stud debouching on the intrados and one stud debouching on the extrados of the element, and it may comprise in combination at least one row of recesses arranged with the same inclination as the studs, each row of recesses comprising at least one recess debouching on the intrados and one recess debouching on the extrados so as to cooperate with the studs of a second bridge element which is to be assembled.

The invention will be better understood from the additional description given below with reference to the drawings which show one non-limitative embodiment of the invention.

Figure 1:
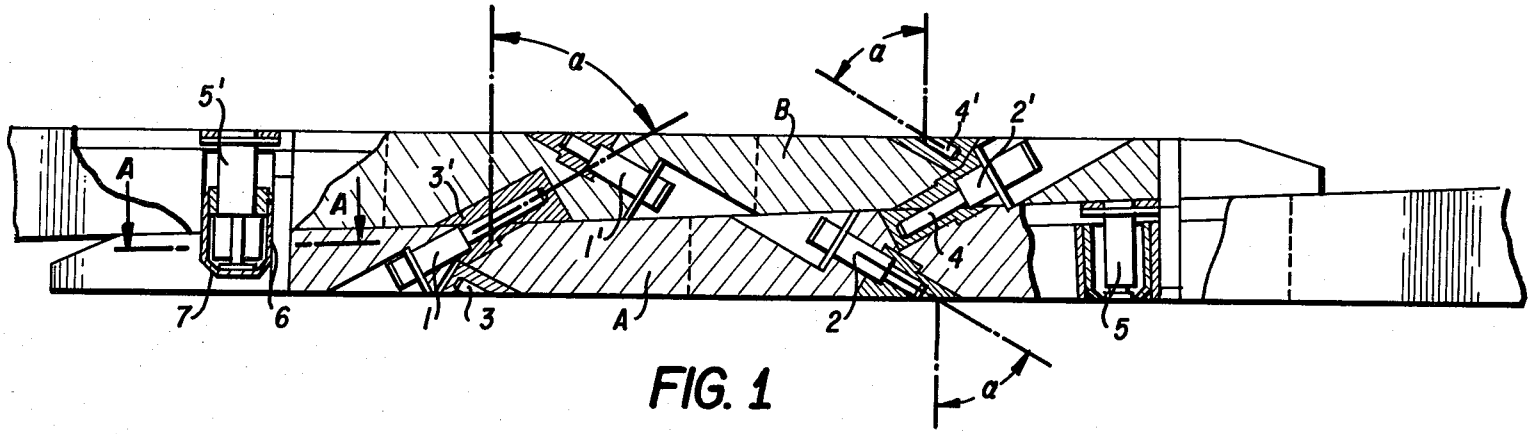
FIG. 1 is a longitudinal section through the end of two bridge elements assembled by means of the device of the invention.

Referring to FIG. 1, a bridge element A is provided at each of its ends with at least one retractable stud 1 debouching on the extrados of the element and located in a longitudinal vertical plane with respect to the element, and on an axis forming an angle $\alpha$ with the normal to the extrados of this element.

The element A also has at least one retractable stud borne by an axis defining an identical angle $\alpha$ with the intrados of the element on which it debouches.

Recesses 3 and 4 arranged with the same inclination, one on the intrados and the other on the extrados, are provided to receive the studs 1', 2' of a second element B, in accordance with the method of assembly selected.

The studs 1, 2, 1', 2' can be maneuvered by any hydraulic, mechanical or electromagnetic means.

The studs 1, 2 as well as the recesses 3 and 4 (1', 2', 3' and 4' respectively of the element B) can be arranged in rows perpendicular to the longitudinal axis, the multiplication of the studs increasing the resistance to stresses of the assembly and decreasing the load borne by each locking stud.

Each element also contains a centering means which makes it possible to place the studs 1 and 2' opposite their recesses 3' and 4.

This centering means consists of a finger 5 (5' in the case of the element B) which can be displaced by any means as well as the studs 1 and 2 and which engages in a recess 7' in the second element.

Figure 3:
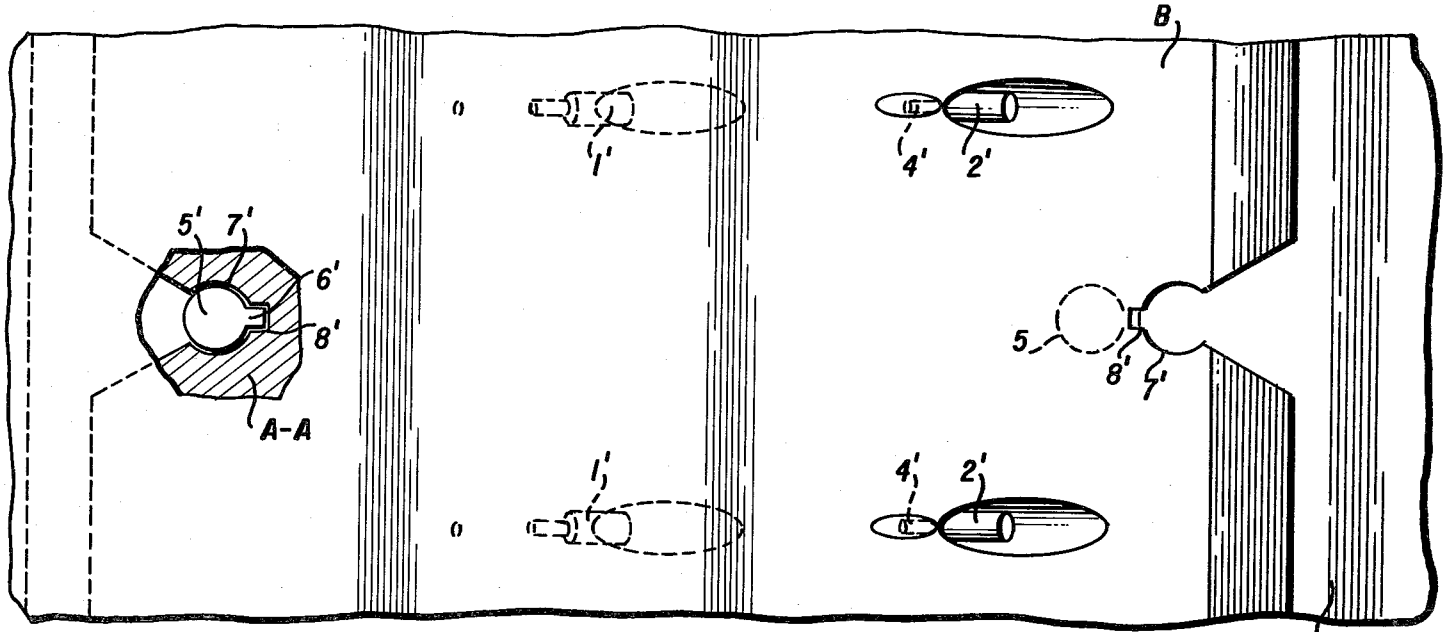
FIG. 3 is a truncated top view of the two assembled elements in accordance with the configuration of FIG. 1.

In order to facilitate the assembly the finger 5 can be locked by means of a key 6 shown more clearly in FIG. 3 in cross section from above.

The key 6 can, in accordance with the variant embodiment shown in FIG. 3, be a fixed key borne by the centering finger 5 and engaging in a keyway 8' in the recess 7'.

In accordance with another variant (not shown), the finger 5 may have a radial borehole and after being placed in position receive a movable key borne by the second element, thus assuring the locking of the centering.

The assembling of two elements is then simple and will be explained only in the case of the example of FIG. 1, that of FIG. 2 following by symmetry.

The two elements A and B are arranged overlapped, the extrados of A supporting the intrados of B, after the centering finger 5' has emerged from the element B. The finger 5' comes into position in its recess 7 by rotation of the upper element until the key 6' comes into position in the keyway 8.

It is then possible to actuate stud 1 of element A and stud 2' of element B and to engage them in their recesses 3' and 4.

During this operation, the studs 1' and 2 as well as the centering finger 5 are maintained retracted since they are not used in this particular case of assembly, they being used only upon the symmetrical assembly, the element B being then located below the element A.

Figure 4:
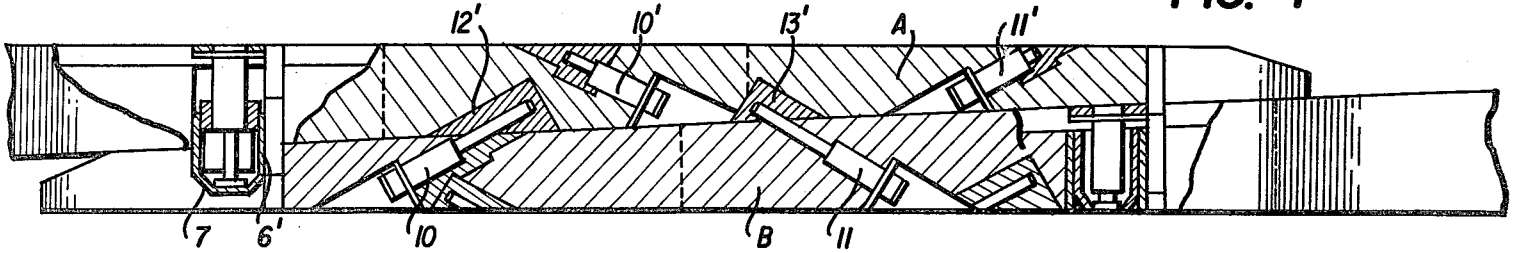
FIG. 4 shows another variant embodiment in which the centering fingrs are no longer inclined with respect to the surface of the element parallel to each other but are symmetrically arranged in chevrons with respect to a vertical to the surface of the element.

In the variant embodiment shown in FIG. 4, the connecting studs are symmetrically arranged in a herringbone pattern with respect to a vertical to the surface on which they debouch.

On the elements shown in FIG. 4, the studs 10 and 11 (or 10' and 11') of the same element debouch on a single face thereof (extrados in the case of element B and intrados in the case of element A) which does not interferes with the interchangeability of the elements or their positioning on extrados or intrados. In another version, not shown, the studs 10 and 11 of one and the same element could be arranged one on the intrados and the other on the extrados, without this introducing any limitation on the invention.

Figure 2:
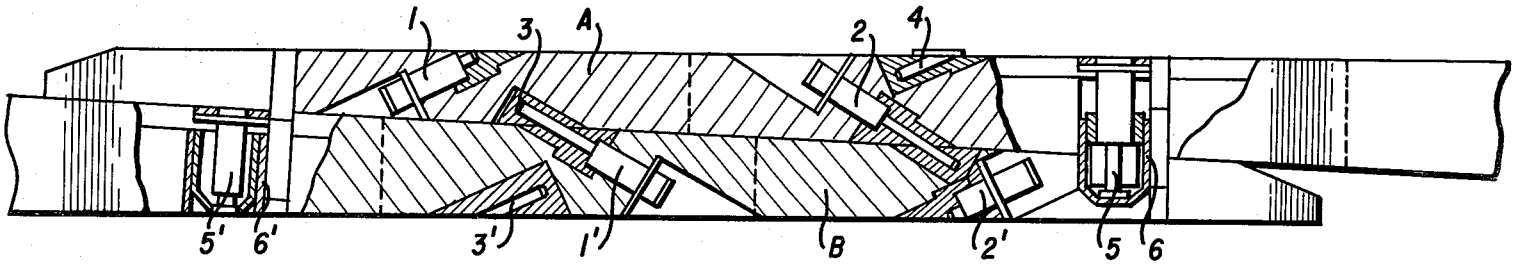
FIG. 2 is a longitudinal section through the two elements in the second configuration permitted by the invention.

The mounting of the device of FIG. 4 is effected in analogy with those of FIGS. 1 and 2, commencing with the centering of the two elements by means of the centering finger of the element placed in upper position and then positioning the studs 10 and 11 in their recesses 12' and 13'.

The inclined position of the studs 1 and 2 (or 10 and 11, depending on the variant selected) has two main advantages over the prior art devices with studs normal to the elements. First, they avoid the requirement that locking means be added in order to hold the assembled elements since it is the combination of two studs oblique in opposite directions which assures that the two elements will be held applied against each other. Second, they permit the assembly to hold better under load due to the automatic take-up of play resulting from their inclined position, as well as by their number, which can be increased depending on the type of vehicle which is to cross the bridge.

The invention therefore is very flexible and may be used to assemble all types of bridges.

We claim:

1. A device for permitting the lap joint connection of two bridge elements, a lower bridge element and an upper bridge element, on intrados or extrados, the lower bridge element being capable of becoming the upper bridge element and vice versea, comprising:

a means for centering the two bridge elements with respect to each other when they assume an overlapping configuration; and a means for connecting the two bridge elements, the connecting means comprising at least two retractable studs belonging to the first bridge element and located on axes oblique with respect to the surface of the first bridge element, the tow studs being adapted to cooperate with at least two recesses in a second bridge element, the recesses having the same inclination with respect to the surface of the second bridge element as the studs have with respect to the surface of the first bridge element.

2. A device according to claim 1, wherein the retractable studs debouch on the extrados of the first bridge element and the recesses debouch on the intrados of the second bridge element.

3. A device according to claim 1, wherein the retractable studs debouch on the intrados of the first bridge element and the recesses debouch on the extrados of the second bridge element.

4. A device according to claim 1, wherein the first bridge element comprises a first retractable stud debouching on its intrados and a second retractable stud on its extrados, and the second bridge element comprises a first recess on the extrados and a second on the intrados, the first and second recesses cooperating with the first and second studs of the first bridge element.

5. A device according to any one of claims 1, 2, 3 or 4, wherein a first bridge element comprises at least one row of two retractable studs, each row of studs being arranged along an axis perpendicular to the longitudinal axis of the first bridge element, the second bridge element having at least one row of recesses adapted to cooperate with the studs of the first bridge element.

6. A device according to claim 5, wherein the centering means for the two bridge elements comprises a retractable centering finger of the first bridge element, located along an axis perpendicular to the surface of the first bridge element, in the highest part of the structure of said first bridge element and adapted to cooperate with a corresponding recess provided in the end of the second bridge element.

7. A device according to claim 6, further comprising a means for locking the centering finger in an extended position.

8. A device according to claim 7, wherein the means for locking the centering finger comprises a fixed key borne by the centering finger which engages a keyway in the second bridge element.

9. A device according to claim 7, wherein the means for locking the centering finger comprises a movable key of the second bridge element which cooperates with a borehole in the centering finger of the first bridge element.

10. A bridge element employing the system of connection of two bridge elements arranged overlapped either on the extrados or on the intrados, as defined in claim 1, wherein the highest part of the bridge element has at least one retractable centering finger, the axis of which is perpendicular to the surface of the bridge element; and the other end of the bridge element has at least one hollow recess adapted to receive a centering finger and to lock it by means of a key.

11. A bridge element according to claim 10, further comprising at least one row, arranged transversely on the element, of retractable studs located on axes oblique with respect to the surface of the bridge element, each row being comprised of sets of two studs, one debouching on the intrados and the other debouching on the extrados of the bridge element; and at least one row of recesses arranged with the same inclination as the studs, each row of recesses being comprised of sets of two recesses, one debouching on the intrados and the other debouching on the extrados, the recesses being placed so as to cooperate with a plurality of studs of a second bridge element which is to be assembled.

12. A bridge element according to claim 10, further comprising at least one row, arranged transversely on the bridge element, of retractable studs located on axes oblique with respect to the surface of the bridge element, each row being formed of sets of two studs both debouching on the same surface of the bridge element which is either intrados or extrados; and at least one row of recesses debouching on the opposite surface so as to cooperate with the studs of a second bridge element which is to be assembled.

* * * * *